United States Patent [19]

Svendsen

[11] 4,195,833

[45] Apr. 1, 1980

[54] FACIAL EXERCISE AID FOR THE FACE, NECK AND JAW

[76] Inventor: Jean M. Svendsen, 9003 Cherrytree Dr., Alexandria, Va. 22309

[21] Appl. No.: 904,023

[22] Filed: May 8, 1978

[51] Int. Cl.[2] ..... A63B 23/00

[52] U.S. Cl. ..... 272/95; 272/119

[58] Field of Search ..... 128/163; 272/94, 95, 272/119, 96; D34/5 K; 2/3 R

[56] References Cited

U.S. PATENT DOCUMENTS

| | | | |
|---|---|---|---|
| D. 235,789 | 7/1975 | Eberhardt | 272/95 |
| 2,882,892 | 4/1959 | Kosior | 272/95 |
| 3,124,353 | 3/1964 | Sharkey | 272/94 |
| 3,128,095 | 4/1964 | Sharkey | 272/94 |
| 3,525,141 | 8/1970 | Smith | 272/119 |
| 3,820,780 | 6/1974 | Tarbox | 272/94 |

OTHER PUBLICATIONS

P.R.N. #1149, "Tension Headache Relief by Halo Weights is Tessted" -Publ. by PACO N.Y., N.Y., 12/18/72.

*Primary Examiner*—Richard J. Johnson

[57] ABSTRACT

A method of toning facial muscles causing a smoothing and lifting of facial contours by selectively exercising certain face, neck and jaw muscles. The method comprises securing a weighted band around the head, contracting selected groups of facial muscles, and then repeatedly raising and lowering the head while in a generally horizontal position.

9 Claims, 5 Drawing Figures

FACIAL EXERCISE AID FOR THE FACE, NECK AND JAW

The invention relates generally to a face, neck and jaw exercise aid, more particularly to an exercise structure to be worn around the head. The value of exercise involving the use of weights to provide increased muscular resistance while performing exercise has been well established. The present invention makes use of this principle of isometric reaction with respect to the muscles of the face, neck and jaw enabling the user to increase the benefits of each movement performed in the system of exercise hereinafter described. The toning and firming of the underlying flesh structure by this controlled resistance to muscular action will also apply to the skin's surface, helping to retain its firmness and youthful elasticity, slowing down the wrinkling process, as skin is only as firm as the flesh structure it covers.

A further object of the invention is to provide the proper amount of weights to be used within the head band as the objective is firmness by limited stressing of predetermined muscles, not extended muscular development. Being aware the face is composed of muscles like the body whose firmness is retained only by appropriate exercise, it has been determined by the inventor that approximately 7 or 8 ounces of weight is the ideal weight for most women and 11 or 12 ounces of weight for men. As the strength of facial muscles vary in persons to a extreme degree, it is not desired by the inventor to limit the amount of weight used only to the afore mentioned weight but to imply that these weights are best suited for the "average" user of my herein described exercise aid. By increasing the amount of times specified muscular movement are performed in the positions described hereinafter, while wearing the weighted head band for controlled resistance to these movement, the benefits of the firming and toning process also increases.

The inventor is aware that other forms of weight can be used and modifications possible in weights and methods of application but it has been ascertained by personal experimentation that the weights most suitable at this time are made of flat sections of rust free metal that are fabric encased individually. These weights are then sewn onto a non-rolling elastic band side by side to provide a smooth but flexible band of weights that will conform confortably to the contours of the head. The weighted elastic band is then placed within a tublar structure and the ends of the tube and the elastic sewn together forming a single seam that completes the circle. This method is used so the weights do not move within the surface band during the exercise movements.

Another objective of the invention is to provide the weights with a soft surrounding that will be firm, gentle but also flexible for ease in placement upon the head, conforming to the contours of the head and remaining in place during the series of exercises herein after described. A tubular seamless knitted structure approximately 23 inches long that is thick but soft somewhat like the fabric of an athletic sock, knitted of a stretch yarn, would provide the movable seamless encasement for the weights. It is to be understood that if a seamless tubular knit is not available a tube can be made by sewing a seam lenthwise down a horizontal cut of suitable fabric but that this seam should not be located on the band where it comes into contact with the skin of the forehead and temple area.

Another objective of the invention is to provide ease in placing and removing the exercise aid from the head. For some users of the aid it is believed the seaming together of the ends of the stretch tube and the weighted elastic band to form a circle slightly smaller than the human head is the best method. Ease in placement and the retaining of the aid securely in place will be accomplished by the flexibility of the stretch tube and the inner elastic band themselves. In the case of use by persons with special needs, i.e. hair style or physical limitations unspecified, a fastener or clasp can be at the ends of the tube to provide for complete ease in opening and closing the exercise aid for placement and removal of the band. One suitable clasp is shown in the drawings included herein but it is not intended to imply that this is the only clasp or fastener suitable for this purpose.

Furthermore an important object of the invention is to provide a facial exerciser that can be kept in a sanitary condition. The inventor kept in mind the washability of the structure in all its parts. The outer knitted tube, the supportive elastic, the non rust encased flat weights and the end fastener being made of plastic or rust free metal. All parts of the exercise aid are durable in usage and inexpensive to manufacture.

The inventor developed the exercise aid, the positions taken and the movements performed which will be described here inafter as a unit each dependent upon the other to strengthen the supportive muscles of the face, neck and jaw. The exercise aid and the excercises performed provide for maximum benefit to the user in the shortest amount of time. Use of this system is not limited to any age group for even the muscular structure of the face, neck and jaw of persons still young will be enhanced and the facial firmness retained far longer into the advanced years. Persons with facial structure beginning to slacken with age will slow down this process of wrinkling, jowls, pouches, drooping mouth corners and sagging neck skin with this facial rejuvination system. It is never too late for the benefits on the muscular structure of the face, neck and jaw of proper exercise are just as great as on any other part of the body. The sagging caused by weight loss will be reduced as will double chins and jowls be toned up using this invention.

Youthful facial contours are also enhanced by body posture and the user becomes increasingly more conscious of the muscular structure of the face, neck and jaw. This awareness promotes voluntary control of facial expression and the correct head and body posture increases the benefits of the exercises performed for the strengthening and shortening of these muscles.

Details of construction of one suitable head band are shown on the drawings herewith included. Reference being made to the accompanying drawings forming a part hereof, in which, FIG. 1 is a perspective view of the outer casing of the exercise aid showing the general position of the weights hereto fore described. A seam is also drawn which brings the band into a circle without the use of a clasp or fastener.

FIG. 2 is a view of one suitable method of clasping the exercise aid to form a circle out of the band when the full opening of the band is desired. The band being approximately 2 in. wide.

Figure 1:
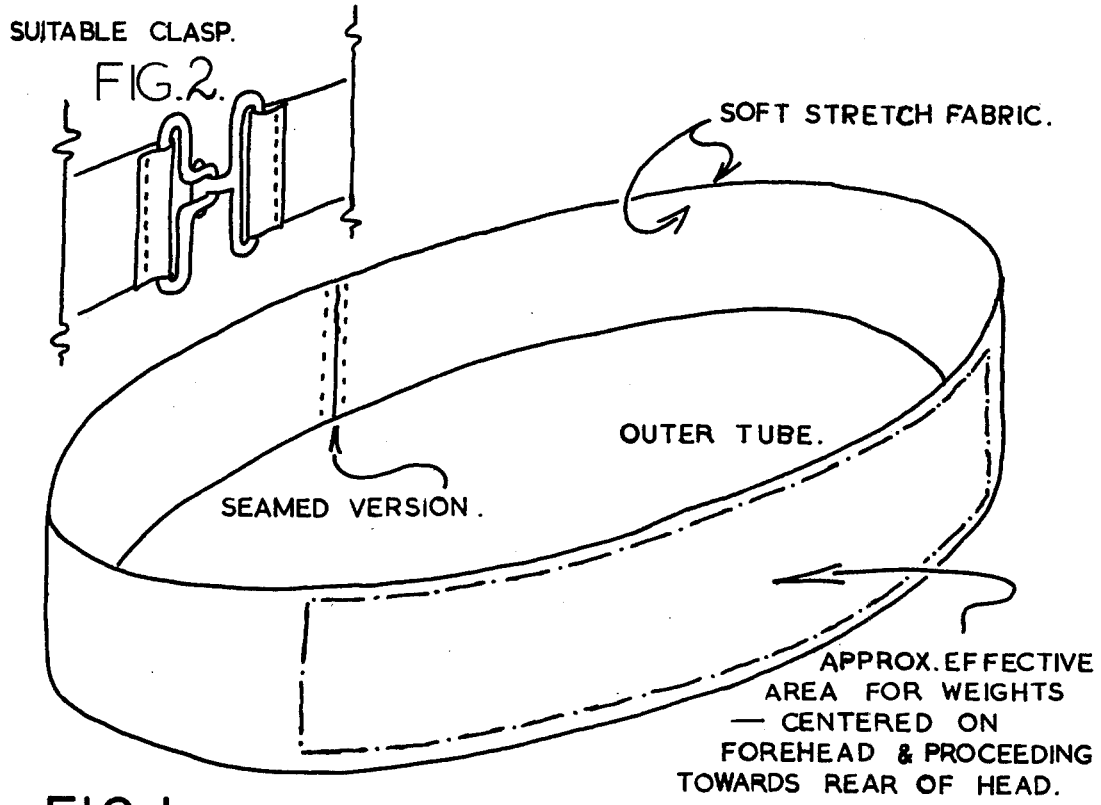
Figure 3:
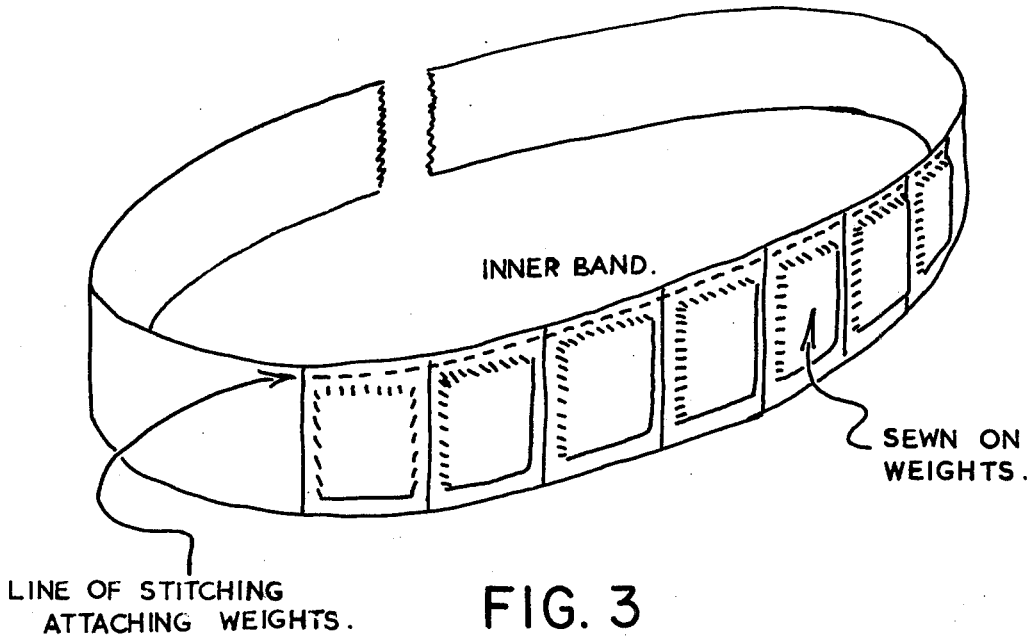
FIG. 3 is a perspective view of the inner structure of the head band showing the elastic base and fabric encased individual flat weights sewn onto the elastic band. Let it be known that the amount of weights shown therein are merely illustrative and would be more if additional weight be required.
Figure 4:
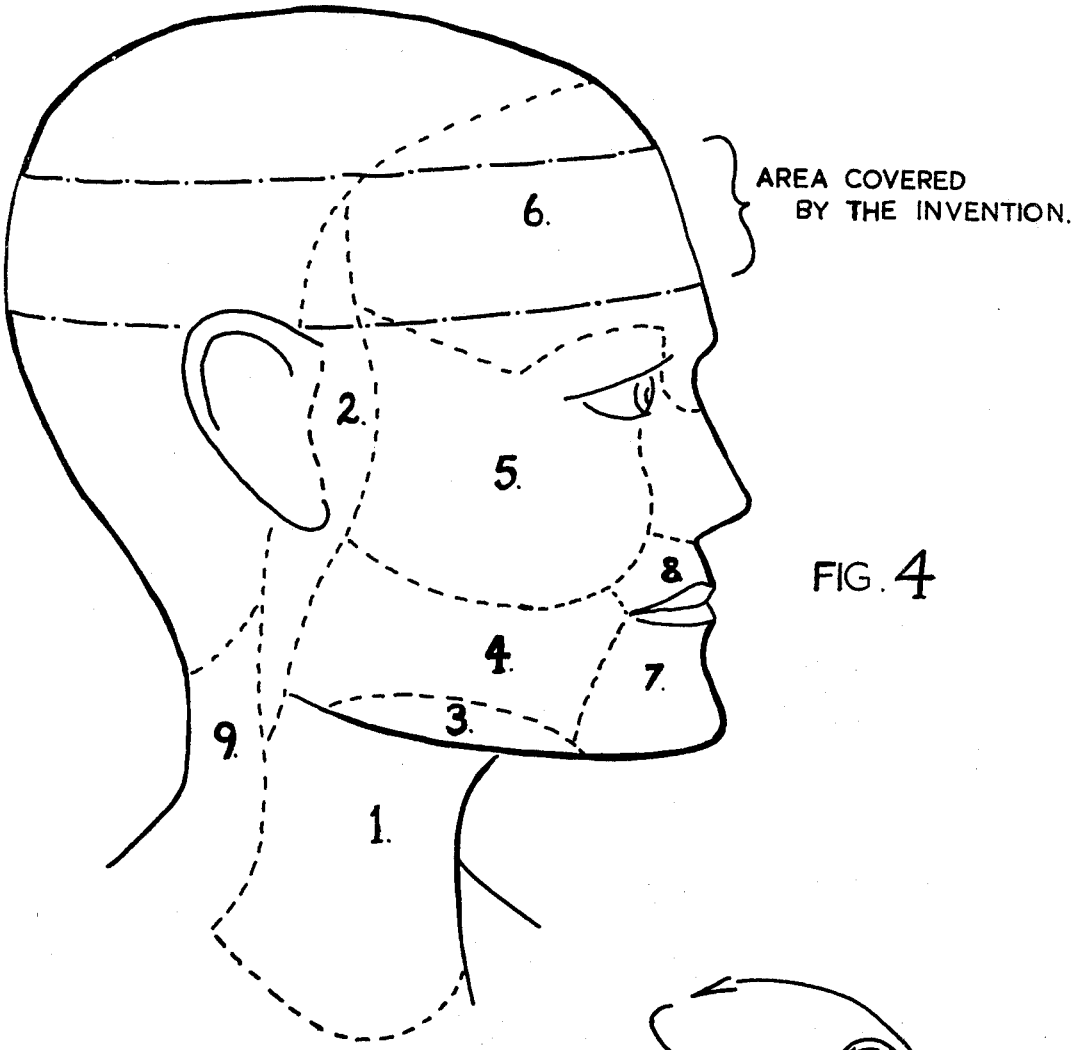
FIG. 4 is a diagram of the sections of the face, neck and jaw effected by the exercise system with section 6 also showing the physical location of the invention upon the head while performing the exercise system.

Included hereinafter will be a description of the exercise process itself performed in total twice daily while wearing the exercise aid in place at all times as shown in FIG. 4. For lifetime physical benefit this system should become as much a part of daily routine as the brushing of the teeth. Also the system can be used for short periods for relief of muscular tension, during weight loss to prevent sagging of the face and neck, or for spot reduction of double chins caused by heredity.

Figure 5:
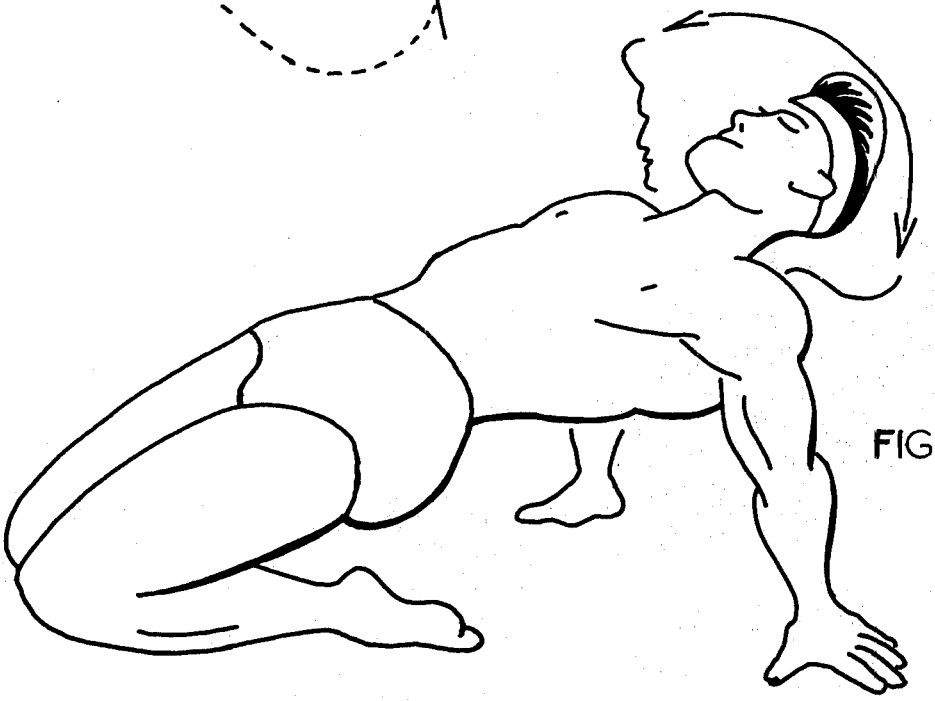
FIG. 5 is a perspective view of the main position taken during the course of exercise. For persons less able a lying position will also be hereinafter described.

For persons unable to take the postion shown in FIG. 5 the strengthening of the face, neck and jaw muscles is still quite possible. While lying across a bed, face up, shoulders supported by the mattress, head wearing the exercise aid and hanging freely over the edge of the mattress, the same group of exercises described hereinafter can be performed.

Facial exercises performed in the position shown in FIG. 5 also have additional benefits because of the increased muscular resistance caused by this position. As can be seen in FIG. 5 the muscles of the neck, shoulders, chest, arms, abdomen, buddocks, legs, and feet are also involved with the face lifting movements. The shoulder muscles are held back and the neck held high after a person performs these exercises preventing dowager hump and a more youthful stance is consciously encouraged.

The strengthening of the muscles of the back of the neck shown as section 9, the Trapezious, Scalenus Medius, Legator Scapulae and Splenius Capitis, eases the muscular tension at the base of the skull and a side benefit of the use of this system can be in certain individuals the relief of chronic tension headache.

As shown in FIG. 5 the basic lifting movement of the face is set in a position to make the maximun use of natural gravity with the addition of controlled amounts of weight lifted, in order to exercise the muscles of the neck, face and jaw. The head is dropped back and lifted up until the chin is brought to the chest. The mouth is closed but relaxed and the tongue touch the roof of the mouth. The lifts are to be performed slowly and rythmically with the times the head is lifted increasing as the muscles involved strengthen. The forehead muscles of section 6 should be flattened consciously to encourage the decrease of the furrows and frown marks of the forehead. Any persons performing the exercise series properly will feel the muscular pull of all the neck, face and jaw muscles as they each work upon the other, for they are interrelated. The sections noted herein are those most specifically involved with the exercise group being performed. During the first group of basic lifts the greatest pull will be felt in the sections shown as 9, 1. 3, and 2.

The second group of face lifts within the total unit are performed with the upper lip pulled back over the teeth and the lower lip pulled up over it putting addition stress on the lower jaw, section 1 and 3, the Platysma, the chin area, section 7 Quadratus Labii Inferioris, the face muscles, Zygomaticus, Quadratus Labbi Superioris, Caninus shown as section 5, and the mouth, Orbicularis Oris, section 8 and the upper part of section 7. Pull on the muscles is felt greatest in sections 9, 1, 7, 8 and 2. This group of exercises also aids in easing the furrows formed in the upper lip and wrinkling of the skin of the chin caused by the aging of these underlying muscles.

A third group of face lifting exercises to be performed in the complete set is one involving specifically sections 5, 7, 8, 4 and 2. The face is lifted as described before with the corners of the mouth brought straight back towards the ears, the teeth bared and the word "Cheek" in mind. Each lift will be felt most specifically when performed correctly, in the cheek area. This exercise strengthens and lifts the upper cheek muscles and also involves the Masseter (side cheek area) and Auricularis Ant. muscles. (temple area). The resulting lifting of the upper cheek muscles, tightening of the neck muscles along with improving the elasticity of the muscles shown in section 2 in the diagram will contribute greatly to maintaining youthful contours of the face. These three exercises form one unit of exercise.

As the face, neck and jaw muscles are sensitive the movements will be felt and the benefits seen within a few weeks if performed regularly. The pull of gravity on the face muscles is easily noticed as the years pass. Early and regular use of the exercise aid and system of exercises described will produce the best results for the longest time. The exercises are not difficult and the exercise aid designed to be easy to handle and long lasting in use so there is no limit to the age of the user and benefits will be seen at all ages. As the muscles increase in firmness and regain their more youthful strength, the amount of times each group in the total unit of exercises are performed will also increase. The use twice daily of the exercise aid as been ascertained as being the most beneficial. The early morning and late evening when the face is clean is advised for circulation is improved by these exercises and the benefits of facial creams would also be inhanced. As an example, a person could begin by doing each lift three times and slowly increase the lifts to doing each lift fifteen times and feel that maximum benefits are being reached at that amount. The time taken up by doing the exercises is minimal. A total of approximately five minutes a day should be all that is required, depending on the lifts attempted and the timing of the user of the exercise aid.

The exercise band was developed by the inventor as a time saver so that benefits derived from the series of exercises performed could be increased in a shorter amount of time expended. Also the exercise aid increases the isometric reaction and the benefits are more long lasting for the time expended.

A more advanced exercise can be added. It is performed exactly as herein before described but specifically for section shown in the drawing as section 3, the jowl area. The face is rotated to the position of chin toward the shoulder, the head dropped back and lifted forward until the chin touches the collar bone of that shoulder. After several lifts, the face is rotated to the other shoulder and the exercise repeated on that side an equal amount of times. This exercise is a little more demanding and should not be attempted until the other three groups in the original unit has been perfected and the muscles strengthened.

Let it be understood that the sections of the face shown in FIG. 4 are illustrative and for use in explaining the system of exercises only. As persons differ in their exercise habits the exercises will be felt in sections other than those described but the use of the exercise aid with its weights will focus the muscular resistance to a great degree.

It will be appreciated that an integrated and unique set of facial exercises have been developed and a weighted head band invented to increase the benefits of these exercises. It is not desired to limit the invention specificially to the exact construction shown and to only the exercises defined herein as modification changes can be suitably resorted to which will still fall within the scope of the invention as claimed.

What is claimed is:

1. A method of toning facial muscles and smoothing and lifting facial contours by selectively exercising certain face, neck and jaw muscles comprising:

a. Securing a weighted headband around the head above the ears with the weights disposed along the band frontally and substantially from ear to ear, b. Positioning the body so that the shoulders are generally parallel to the floor and the upper body is rearwardly inclined toward a generally horizontal position and with the head tilted backwardly and downwardly as far as possible, c. Assuming a selected facial expression by contracting certain facial muscles which are intended to be exercised, d. Slowly raising the head face forward until the chin is as close as possible to the chest, then lowering the head and repeating this step at least three times while maintaining the selected facial expression with the muscles contracted.

2. The method of claim 1, wherein the selected facial expression is formed by holding the lower lip up and overlapping the upper lip.

3. The method of claim 1, wherein the selected facial expression is formed by rolling the center of the lips in and holding them together while forcing the outer edges apart for air passage.

4. The method of claim 1, wherein the selected facial expression is formed by baring the teeth while pulling the outer corners of the lips back toward the ears, and with the tongue pressed against the roof of the mouth.

5. The method of claim 1, wherein the body is disposed on a generally horizontal support with the head overhanging the edge of the support.

6. The method of claim 1, wherein the body is positioned in a rearwardly inclined kneeling position with the hands placed behind the body on the floor and supporting the upper body.

7. The method of claim 1, wherein the body is in a standing position feet placed slightly apart, with the upper body rearwardly inclined, arms extended forwardly and hands grasping a stationary support.

8. The method of claim 1, wherein the exercise is performed with the head rotated toward one shoulder and repeated with the head rotated toward the other shoulder.

9. The method of claim 1, including moving the upper body to a forwardly inclined position, lowering the head toward the knees, relaxing the facial muscles and maintaining this position for several seconds.

* * * * *